United States Patent [19]

Bodai

[11] 4,316,580

[45] Feb. 23, 1982

[54] APPARATUS FOR FRAGMENTING FLUID FUEL TO ENHANCE EXOTHERMIC REACTIONS

[75] Inventor: Conrad A. Bodai, Davis, Calif.

[73] Assignee: Sontek Industries, Inc., Dallas, Tex.

[21] Appl. No.: 57,394

[22] Filed: Jul. 13, 1979

[51] Int. Cl.[3] ..... B05B 1/34; B05B 17/06

[52] U.S. Cl. ..... 239/466; 239/543; 239/545

[58] Field of Search ..... 239/101, 102, 461, 463, 239/466, 468, 486, 487, 490–497, 543–545; 261/DIG. 39, DIG. 48, DIG. 55, DIG. 78

[56] References Cited

U.S. PATENT DOCUMENTS

| | | | |
|---|---|---|---|
| 1,416,995 | 5/1922 | Stroud . | |
| 1,729,382 | 9/1929 | Harel . | |
| 1,752,506 | 4/1930 | Portail . | |
| 1,939,302 | 12/1933 | Heaney | 261/1 |
| 2,014,907 | 9/1935 | Myers | 261/79 R |
| 2,273,979 | 2/1942 | Mock | 261/1 |
| 2,364,987 | 12/1944 | Lee | 261/78 R |
| 2,453,595 | 11/1948 | Rosenthal . | |
| 2,536,832 | 1/1951 | Altorfer | 239/468 |
| 2,687,780 | 8/1954 | Culhane . | |
| 2,791,994 | 5/1957 | Grieb . | |
| 2,808,012 | 10/1957 | Schindler . | |
| 2,968,147 | 1/1961 | Truly, Jr. et al. . | |
| 3,095,369 | 6/1963 | Jager . | |
| 3,143,401 | 8/1964 | Lambrecht . | |
| 3,227,202 | 1/1966 | Morgan . | |
| 3,323,550 | 6/1967 | Lee | 138/39 |
| 3,332,231 | 7/1967 | Walsh . | |
| 3,336,017 | 8/1967 | Kopa | 261/128 |
| 3,376,027 | 4/1968 | Kopa | 261/145 |
| 3,395,899 | 8/1968 | Kopa | 261/22 |
| 3,459,162 | 8/1969 | Burwinkle et al. | 123/122 |
| 3,496,919 | 2/1970 | Gerrard | 123/122 |
| 3,519,407 | 7/1970 | Hilborn . | |
| 3,539,157 | 11/1970 | Fort | 261/34 |
| 3,554,443 | 1/1971 | Hughes | 239/102 X |
| 3,685,808 | 8/1972 | Budai | 261/1 |
| 3,724,763 | 4/1973 | Braun | 239/490 |
| 3,730,160 | 5/1973 | Hughes | 261/1 X |
| 3,756,575 | 9/1973 | Cottell | 261/1 |
| 3,762,385 | 10/1973 | Hollnagel | 123/122 A |
| 3,787,168 | 1/1974 | Koppang et al. | 431/354 |
| 3,847,125 | 11/1974 | Malherbe | 123/119 E |
| 3,857,375 | 12/1974 | Jackson | 123/141 |
| 3,860,173 | 1/1975 | Sata | 239/102 |
| 3,861,852 | 1/1975 | Berger | 239/102 X |
| 3,885,902 | 5/1975 | Fujieda et al. | 239/102 X |
| 3,907,940 | 9/1975 | Thatcher | 239/102 X |
| 3,914,953 | 10/1975 | Cherry | 261/DIG. 39 X |
| 3,976,726 | 8/1976 | Johnson | 261/1 |
| 4,029,064 | 6/1977 | Csaszar et al. | 261/DIG. 48 X |
| 4,034,025 | 7/1977 | Martner | 261/DIG. 48 X |
| 4,038,348 | 7/1977 | Kompanek . | |
| 4,079,714 | 3/1978 | Saito . | |
| 4,099,504 | 7/1978 | Bickhaus . | |
| 4,100,896 | 7/1978 | Thatcher et al. . | |
| 4,105,004 | 8/1978 | Asai et al. . | |
| 4,106,459 | 8/1978 | Asai et al. . | |

FOREIGN PATENT DOCUMENTS

| | | | |
|---|---|---|---|
| 389785 | 6/1921 | Fed. Rep. of Germany | 261/79 R |

OTHER PUBLICATIONS

Yankee Oilman, Jan. 1977 Issue (Annual Oil Heat Issue), pp. 10 and 11.

Specification for Carlin "CRD" Oil Burners, Models 100 CRD, 101CRD, The Carlin Co., Wethersfield, Conn. 06109.

*Primary Examiner*—Andres Kashnikow

[57] ABSTRACT

The specification discloses apparatus for fragmenting fluid fuels into submicron size constituents of substantially uniform size for improved combustion and blue flame burning. In an improved nozzle (10), fluid fuel at constant pressure is introduced tangentially into a frustroconical swirl chamber (20) whereby vortical flow of the fluid is induced. A frequency multiplier and amplitude amplifier (30) for generating an ultrasonic field of constant high frequency is disposed downstream of the swirl chamber (20) in coaxial alignment therewith. The frequency multiplier and amplitude amplifier (30) includes a generally cylindrical compression chamber (32), open at the upstream end to receive the vortical flow and substantially closed at the downstream end. The compression chamber (32) is peripherally intersected by a ring of paraxially aligned multiplier cavities (34) of smaller diameter which are open at the upstream end to define a series of ports (36) whereby vortical flow in the compression chamber (32) may be discharged into the multiplier cavities (34). The multiplier cavities also open at the downstream end are arranged to provide a highly concentrated force field of constant ultrasonic frequency for fragmenting fluid fuels into constituents of substantially uniform size.

16 Claims, 9 Drawing Figures

APPARATUS FOR FRAGMENTING FLUID FUEL TO ENHANCE EXOTHERMIC REACTIONS

TECHNICAL FIELD

The invention pertains to apparatus for atomizing fluid fuel for improved combustion reactions and more particularly, to apparatus for cavitating, superatomizing and degassing fluid fuels into gaseous phase constituents of uniform, submicron size by sonication to achieve improved combustion and blue flame burning.

BACKGROUND ART

With the world's consumption of oil rapidly outpacing available supply producing growing shortages, the search for new methods for more efficiently burning available oil becomes particularly exigent. It is well known that to achieve the most efficient combustion of liquid fuels, i.e., combustion with maximum heat and with minimal pollutant byproducts, known as blue flame burning, the liquid fuel must be fragmented in an oxygen rich environment into constituents approaching molecular size and that the size distribution of the constituents must be essentially uniform. By these criteria, the combustion reactions produced by conventional nozzles are characteristically inefficient. In most conventional nozzles, for example, the size distributions of the atomized particles varies widely, from 300 to about 10 microns and the average (weighted) size of particles produced is about 40 microns. As a result, most conventional nozzles produce so-called "yellow flame" burning with a higher percentage of pollutants and with a less efficient combustion reaction in comparison with the "blue flame" or so-called "cold burning." There is, therefore, a need for an apparatus for rapidly fragmenting liquid fuels into submicron constituents of essentially uniform size to obtain blue flame burning.

DISCLOSURE OF THE INVENTION

In accordance with the present invention, apparatus is disclosed for fragmenting liquid fuels into constituents of substantially uniform, submicron size to produce improved combustion and blue flame burning.

According to a first embodiment of the invention, fluid fuel at constant pressure is tangentially introduced into a swirl chamber of generally circular cross section whereby vortical flow of the fluid is induced. A frequency multiplier and amplitude amplifier is provided for generating an ultrasonic field of constant frequency. The frequency multiplier and amplitude amplifier includes a generally cylindrical compression chamber disposed downstream of the swirl chamber in coaxial alignment therewith. The compression chamber is open at the upstream end, closed at the downstream end, and peripherally intersected by a plurality of generally cylindrical multiplier cavities of smaller diameter than the compression chamber. The multiplier cavities are open at the upstream end such that a series of ports are provided in the compression chamber whereby the vortical flow in the compression chamber may be discharged into the multiplier cavities. The multiplier cavities, also open at the downstream end, are paraxially aligned with the compression chamber and arranged in a ring coaxial with the compression chamber to provide a high energy ultrasonic field of constant frequency for fragmenting the fluid into constituents of substantially uniform, submicron size.

According to a second embodiment of the invention, fluid fuel at constant pressure is tangentially fed into a swirl chamber of generally circular cross section whereby vortical flow of the liquid is induced. A frequency multiplier and amplitude amplifier is provided for generating an ultrasonic field of constant frequency. The frequency multiplier and amplitude amplifier includes circular compression chamber and a trepanning disposed downstream of the swirl chamber coaxially aligned therewith. The compression chamber is open at the upstream end and closed at the downstream end. Pairs of multiplier cavities having smaller diameter than the compression chamber are disposed downstream of the compression chamber, the multiplier cavities being arranged in a ring of opposing pairs. Each of the multiplier cavities is perpendicular to the axis of the compression chamber and communicates with the compression chamber by the trepanning through ports in compression chamber. The members of each pair of cavities are coincident such that their flows are discharged along a head-on collision course to produce an orthokinetic interaction.

According to a third embodiment of the invention, fluid fuel at constant pressure is tangentially introduced into a swirl chamber of generally circular cross section whereby vortical flow of the liquid is induced. A frequency multiplier and amplitude amplifier is provided for generating an ultrasonic field of constant frequency. The frequency multiplier and amplitude amplifier includes a generally cylindrical compression chamber disposed downstream of the swirl chamber, coaxially aligned therewith. The compression chamber is open at the upstream end, closed at the downstream end and is peripherally intersected by a plurality of generally cylindrical multiplier cavities of smaller diameter than the compression chamber to define a series of ports whereby the vortical flow in the compression chamber may be discharged into each of the multiplier cavities. The multiplier cavities are arranged in pairs relative to the axis of the compression chamber, the members being positioned oppositely one another with the axis of each member being oblique to the axis of the compression chamber at a common angle thereto such that each of the multiplier cavities discharges the flow at an angle to the axis of the nozzle.

BRIEF DESCRIPTION OF DRAWINGS

A more complete understanding of the invention and its advantages will be apparent from the following Detailed Description taken in conjunction with the accompanying drawings in which.

DETAILED DESCRIPTION

Figure 1:
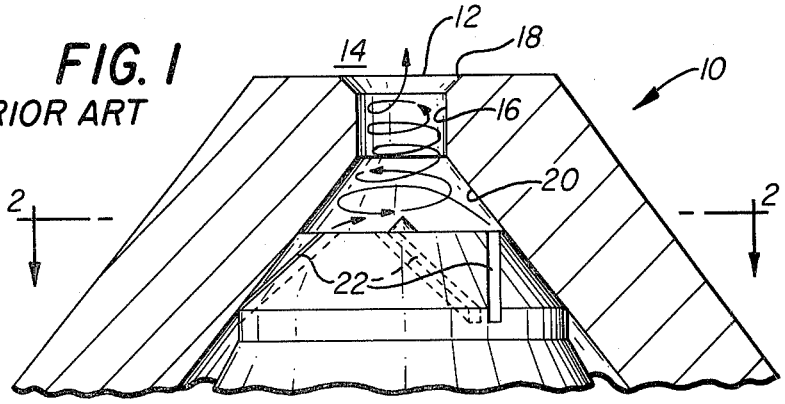
FIG. 1 PRIOR ART
FIG.1 is a schematic section view of a conventional oil burner nozzle.

Two physical conditions which favorably affect the stoichiometry of the combustion reaction of fluid fuels are a superfine size of constituent particles and uniformity in size distribution. The present invention is directed to structure for cavitating and atomizing fluid fuels into droplets of uniform size in the submicron range, which constituents are then further broken down or degassed to molecular or near molecular size to achieve improved stoichiometry of combustion and blue flame burning. From the standpoint of the physics of the invention, three physical phenomena are taking place: one, cavitation of the fluid fuel by an ultrasonic field such that the gaseous constituents dissolved in the liquid are rapidly dispersed into the vapor phase, two, superatomization of the vapor phase or aerodisperse medium (i.e., atomization of the particles into constituents of submicron size). These three inextricably related sonic processes are collectively referred to as fragmentation.

When an intense sonic disturbance agitates the interface between a liquid and air, a thin film of liquid is thrown up, which rapidly dissipates into a fine fog of droplets. In this process, known as cavitation, the intensity of the mist or fog is a function of the surface tension of the liquid and the magnitude of the sonic disturbance. The size of the droplets produced in the fog is related to the frequency of the disturbance, while the size distribution of the droplets is related to the frequency variation. The metamorphosis from the liquid to the gaseous state is known as the vapor phase and its prominent characteristics are the microsize of the constituents and the uniformity of the size distribution. While there is less than complete understanding of the mechanisms of cavitation, atomization and degassing, it is presently recognized that the degree and uniformity of fragmentation depends in a rather complicated way on the frequency and amplitude of the sonic disturbance as well as other chemical and physical parameters, such as the reactivity and stability of the molecules, the volatility of the fuel and the ambient temperature to name just a few. For further information about these parameters, reference is made to: Carlin, *Ultrasonics,* p. 239 et seq.

From a pyrotechnical point of view, an aerodisperse system, in particular the vapor phase of a liquid fuel, approaches its perfect stoichiometric conditions when its constituents come near to the reactant molecular size and its size distribution is relatively narrow. Thus, simultaneously promoting superatomization and uniformity of size results in an improved oxidation reaction as the microdroplet surface contact ratio relative to the oxidizing molecule is improved, producing gaseous blue flame burning and elimination of pollutants as minimum byproducts of the reaction.

In the present invention, controlled constant ultrasonic frequencies are generated to promote uniform superatomization and the necessary vibrational energy is imparted to the fuel constituents to cause cavitation and ultimately degassing to improve the stoichiometry of the combustion reaction.

Figure 2:
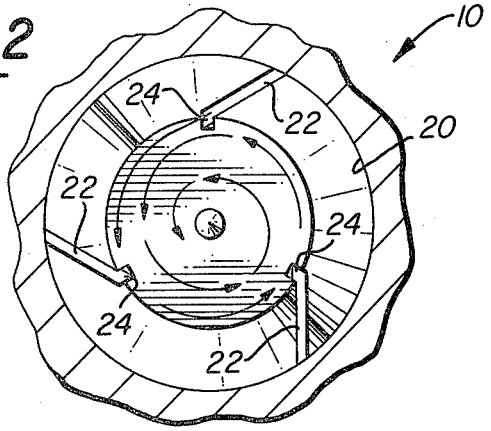
FIG. 2 PRIOR ART
FIG. 2 is a schematic section view of the swirl chamber of the nozzle of FIG. 1.

Referring now to FIG. 1, a conventional burner nozzle 10 is shown having a central orifice 12 opening into a reaction environment or combustion zone 14 of a typical oil burner. Orifice 12 is defined by a substantially cylindrical cavity 16, the walls of which are outwardly beveled at the exit end 18 to direct the spray in a conical pattern. A swirl chamber 20 is provided downstream of and in open communication with orifice 12, defining a forwardly tapered frustroconical cavity for producing vortical flow of liquid fuel at increasing angular frequencies in the direction of the orifice as a result of the decreasing radius of the chamber. As best seen in FIGS. 1 and 2, fuel is fed at relatively high pressure into swirl chamber 20 through slantwise tangential passageways 22 to impart rotational flow to the fluid. As best seen in FIG. 2, fuel is fed tangentially to the walls of chamber 20 through openings 24.

Fuel is fed to swirl chamber 20 at high pressures, i.e., pressures of about 100 psi, subjecting the fuel to a rotational flow having a forward axial velocity of approximately 40 mph. At the orifice 12, thin sheets of the fuel rapidly break up into droplets, which continue in relatively straight trajectories unless modified by motion of the air stream in the combustion chamber. As earlier pointed out, the variation in size of these droplets is characteristically large (from 300 to 10 microns) and typically the average (weighted) size of these droplets is about 40 microns, considerably in excess of the 20 micron threshold characteristic of blue flame burning.

In the present invention, uniform superatomization is enhanced by a constant, high frequency, high energy sonic field produced by a frequency multiplier and amplitude amplifier. This structure acts both as a frequency multiplier for generating the required constant ultrasonic frequencies and an amplitude amplifier for imparting sufficient vibrational energy to the aerodisperse medium to cause cavitation, superatomization and degassing of the superatomized constituents. Frequency multiplication is produced by coupling a vortex generator to a modified "vortex whistle", whereby the angular frequency of the driving fluid is arbitrarily multiplied without increasing the flow impedance of the system. In the first embodiment of the invention, the amplitude amplification is produced by superposition of a number of inphase resonating sources of uniform strength which constructively interfere to produce a resultant force field several times more intense than the individual resonators. By appropriate geometric arrangement of resonators, the sonic radiation pattern may be highly directed or "focused" into a relatively small area of the flow such that the available energy is most efficiently exploited. In the second embodiment of the invention, a region of amplified energy is produced by the destructive interaction of oppositely directed force fields, whereby the fluid constituents receive large impulses due to rapid transfers of angular momentum from opposing high frequency vortices. In the third embodiment, the fluid constituents are subjected to both constructive and destructive wave interactions.

Figure 3:
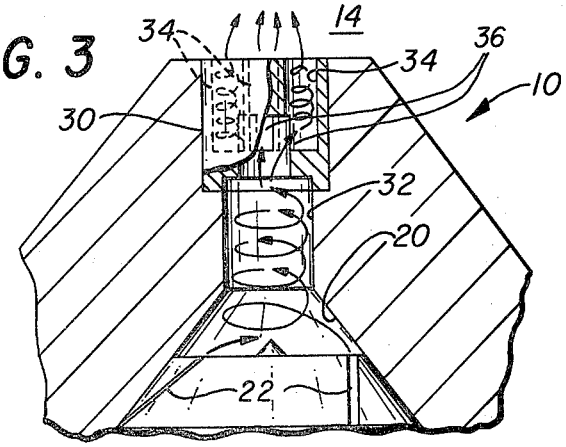
FIG. 3 is a schematic section view of a first embodiment of the invention which produces parakinetic wave interactions.

Referring now to FIG. 3, in which like numerals are used to refer to corresponding elements in FIGS. 1 and 2, the first embodiment of the invention is shown in which the conventional nozzle 10 of FIG. 1 is modified by the use of a frequency multiplier and amplitude amplifier 30 in the nozzle which produces a parakinetic constructive interaction in combustion zone 14. The term "parakinetic constructive interaction" is descriptive of the inphase sonic disturbances produced by the frequency multiplier and amplitude amplifier 30, which propagate parallel to one another and interact constructively by superposition, in contradistinction to "orthokinetic destructive interactions," wherein the various inphase sonic disturbances produced by the sonic generator collide head-on, resulting in a destructive interaction in which all available energy is dissipated in the mechanical breakdown of particles in the zone of collision. In the second embodiment, referred to below, the frequency multiplier and amplitude amplifier 30 has been modified to produce an "orthokinetic destructive interaction", while in the third embodiment the structure has been further modified to produce both "parakinetic constructive" and "orthokinetic destructive" interactions as more fully explained below.

In the first embodiment of the invention shown in FIG. 3, the frequency multiplier and amplitude amplifier 30 is disposed in a nozzle 10 which may be interiorly modified to seat the structure as shown in FIG. 3. With the frequency multiplier and amplitude amplifier 30 so placed in the nozzle 10, orifice 12 is essentially closed from the downstream end. However, the interior of nozzle 10 communicates with combustion zone 14 through a ring of smaller peripherally intersecting cavities, as shown in greater detail in FIG. 4.

Figure 4:
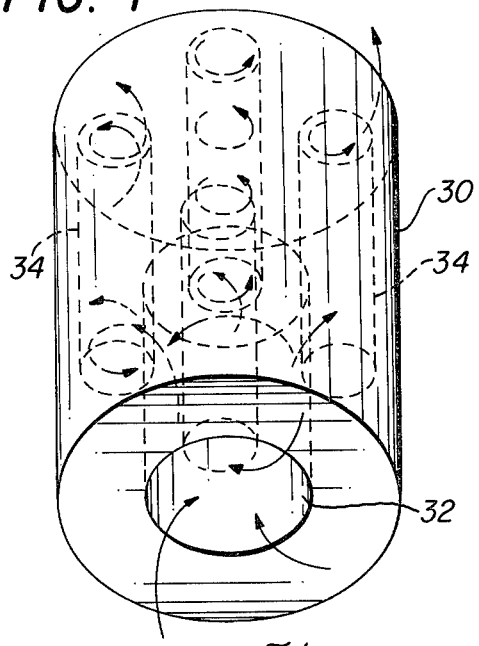
FIG. 4 is an isometric view of the frequency multiplier and amplitude amplifier of FIG. 3.
Figure 5:
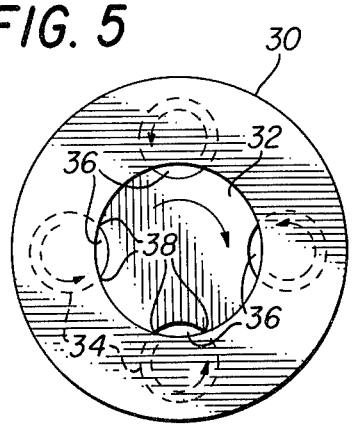
FIG. 5 is an end view of the frequency multiplier and amplitude amplifier of FIG. 4.

Referring now to FIG. 4, frequency multiplier and amplitude amplifier 30 is shown having a cylindrical compression chamber 32, which is open at the upstream end and closed at the downstream end. The compression chamber 32 is of smaller diameter than the downstream end of the swirl chamber 20 and serves to compress the vortex thereby increasing the angular velocity of the flow. Compression chamber 32 communicates indirectly with the combustion zone 14 outside the nozzle through several cylindrically shaped, paraxially oriented chambers, each of which defines a resonating multiplier cavity 34. The walls of cavities 34 radially overlap the periphery of compression chamber 32 sufficiently to permit the vortical flow in the compression chamber to be subdivided and discharged into smaller vortices in the multiplier cavities 34. Since the diameters of the multiplier cavities are much smaller than the diameter of the compression chamber 32, the vortices created in the multiplier cavities 34 will have increased angular velocity as per the law of conservation of angular momentum, although the direction of rotation will be opposite to that in the compression chamber 32. The overlapping walls of the compression chamber 32 and multiplier cavities 34 intersect to define ports 36, which are bounded by sharp knife edges 38 where the walls intersect, as best seen in FIG. 5. The knife edges 38 provide low loss frequency coupling between the compression chamber 32, on the one hand, and the multiplier cavities 34, on the other. If the ports 36 are properly dimensioned so as to not create substantial flow impedance, low loss frequency coupling is achieved.

When the fluid rotating at high angular frequencies in a compression chamber 32 encounters the knife edges 38, the flow behaves essentially as in a "vortex whistle". The multiplier cavities 34 resonate like organ pipes, in phase and with uniform intensity, each resonating cavity, or resonator, producing a resulting disturbance which constructively interferes with the others to produce a high energy field of much greater magnitude than that produced by a single resonating cavity. The geometry of the multiplier cavities 34 has been carefully selected to provide a ring of inphase radiating energy sources of uniform intensity. The energy radiated by such a configuration is highly directional and can be described by the equation:

$$R_\alpha = J_o(2\pi R/\lambda)$$

Where:

$R_\alpha$ = ratio for the pressure for an angle a to the pressure for angle a = 0

$J_o$ = Bessel function of zero order

R = radius of the circle in centimeters $\alpha$ = angle between the axis of the circle and the line joining the point of observation in the center of the circle.

Figure 6:
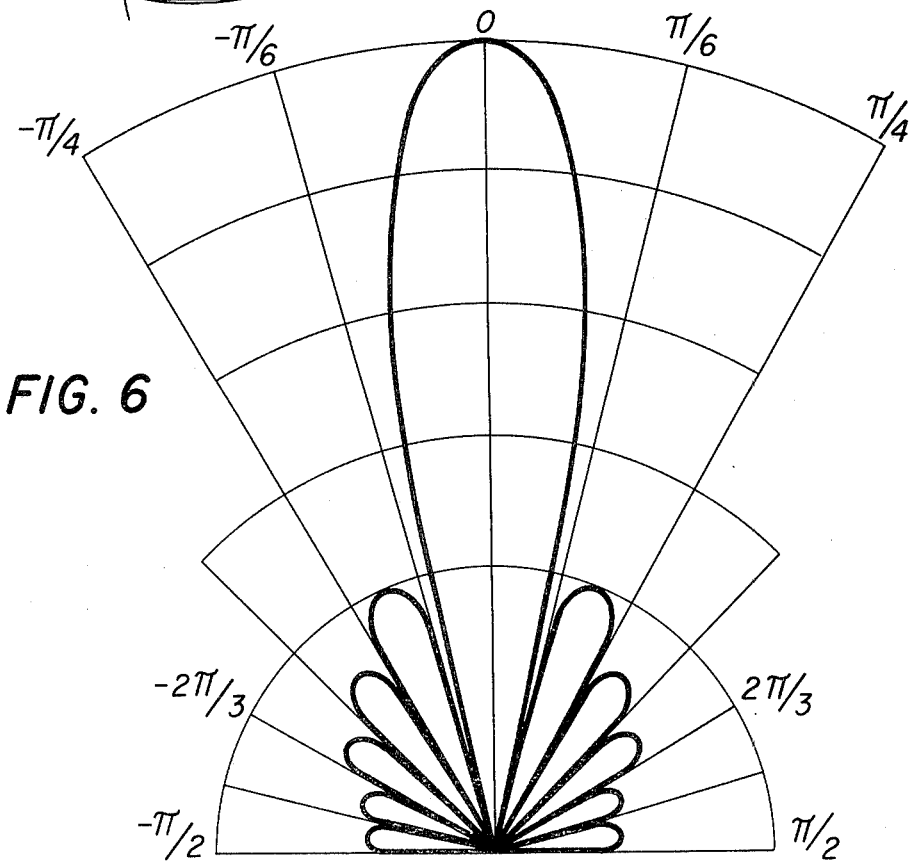
FIG. 6 is a graph of the directivity pattern of a ring of point sources vibrating inphase with uniform intensity.

FIG. 6 is a graph of the directivity pattern for a radiating ring of point sources which approximates the geometry of the multiplier cavities 34. The polar coordinate represents the sonic pressure at some predetermined fixed distance from the ring and the polar angle is the angle of observation, taking the zero degree angle as the axis of the ring. As is evident in FIG. 6, essentially all of the energy is radiated into a relatively small region of space. In three dimensions, of course, the directivity pattern will be represented by a surface of revolution about the axis of the ring, which will define an envelope for the spray pattern of frequency multiplier and amplitude amplifier 30. For further details concerning the radiation pattern of a ring of uniform vibrating sources, reference should be made to: Olson, *Acoustical Engineering,* (1957) Van Nostrand Co., Inc.

The compression chamber 32 and multiplier cavities 34 together comprise a "modified vortex whistle". The properties of a "vortex whistle" shared by the present invention have important and heretofore unrecognized application to the problem of fragmenting fluids into microsized constituents of uniform size. The basic vortex whistle, which was described by Vonnegut in *The Journal of the Acoustical Society of America,* Volume 26, No. 1, January, 1954, is a pure sonic device consisting generally of two coaxial cylindrical cavities: a large inlet cavity into which air or other incompressible fluids under pressure are tangentially introduced and a smaller coaxially aligned output cavity into which the vortex in the larger cavity undergoes increased angular velocity as the result of the conservation of angular momentum. Fluid in vortical motion in the first cylindrical cavity passing into the second cavity produces an intense acoustical disturbance at the exit of the outlet cavity. Vonnegut discovered that the frequency of the disturbance produced exhibits roughly linear dependence on the volume fluid flow rate or on the square root of the pressure gradient of the fluid entering the first cavity; and he empirically determined that the relationship between the frequency of the disturbance, the diameter of the exit orifice, and the pressure gradient could be expressed by the following relation:

$$f = \alpha\left(\frac{V_c}{\pi D}\right)\sqrt{\frac{P_1 - P_2}{P_1}}$$

Where:

f = frequency of the disturbance $V_c$ = speed of sound

D = diameter of the exit orifice $P_1$ = entering pressure $P_2$ = exhaust pressure $\alpha$ = constant less than 1

Because the frequency multiplier and amplitude amplifier 30 shown in FIG. 4 behaves essentially as several "vortex whistles" tuned to the same frequency, the properties of the "vortex whistle" can be exploited to produce a sonic field of constant, ultrasonic frequency. By controlling the pressure or volume flow rate of the fluid and by properly selecting the relative dimensions of the compression chamber and multiplier cavities, frequencies sufficient to atomize droplets to a predetermined size can be generated. For example, at high pressures, i.e., pressures of about 100 psi, which are typical in conventional household oil burners, frequencies up to about 10 MHz are obtainable with the frequency multiplier and amplitude amplifier shown in FIGS. 4 and 5. Generally, it has been found that frequencies in the megaHertz range are sufficient to fragment fluid fuels to submicron size, although the particular frequencies required will depend on the relative dimensions of the cavities 34 and the compression chamber 32 as well as the properties of the particular fluid. As the frequency of the sonic field produced is a function of the volume flow rate or the pressure gradient of the oil pump, a constant frequency can be produced by controlling variations in the pressure of the pump, which in turn causes uniform atomization of particles. As conventional oil pumps used in household oil burners typically supply or may be adjusted to supply fuel at constant pressure, commercially available fuel pumps may be employed to supply fluid to the frequency multiplier and amplitude amplifier at constant pressure. In practice, the output conduit of the pump will be connected directly to slantwise passageways 22 which communicate with the swirl chamber 20.

In summary, the high intensity field produced by the generator, which is due mainly to the geometry of the multiplier cavities 34, insures sufficient vibrational energy for effective cavitation, atomization and degassing of fluid constituents into molecular or near molecular size.

Figure 7:
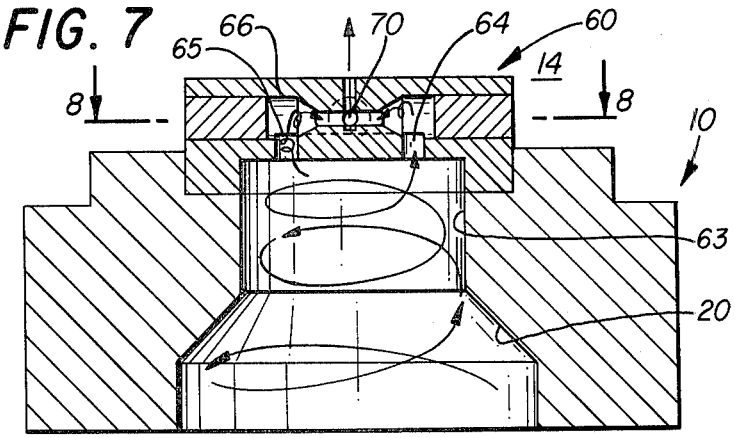
FIG. 7 is a schematic section view of a second embodiment of the invention which produces orthokinetic particle interactions.
Figure 8:
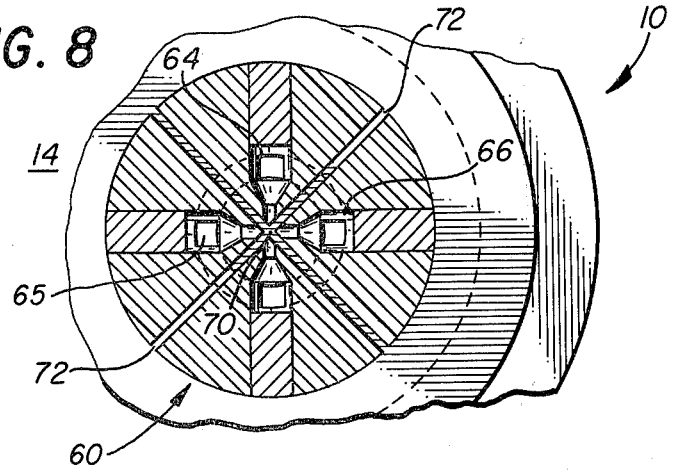
FIG. 8 is a section view of the second embodiment of the invention taken along the line 8—8 of FIG. 7.

FIGS. 7 and 8 illustrate the second embodiment of the invention in which orthokinetic destructive wave interactions are produced. The orthokinetic interaction provides even more favorable conditions for superatomization than can be achieved with the first embodiment. In the second embodiment, shown in FIGS. 7 and 8, the nozzle is modified to contain a different multiplier and amplitude amplifier 60. As best seen in FIG. 7, a circular compression chamber 63 is provided downstream of swirl chamber 20. Chamber 63 terminates at its downstream end in an annular trepanning 64 in the closed end of the chamber. The trepanning 64 communicates with pairs of cylindrically shaped cavities 66 which are located downstream of the trepanning 64 and whose axes lie in the radial plane. Communication between the trepanning 64 and cavities 66 is provided by a series of ports 65 in the downstream wall of the trepanning. Trepanning 64 and cavities 66 are essentially the inlet and outlet cavities of the "vortex whistle," although in this version of the "vortex whistle", the output cavity is not coaxial with the larger inlet cavity, but is perpendicular thereto. In this structure, the parakinetic vortices are converted into orthokinetic interactions by the frequency multiplier cavities.

The cavities 66 are arranged in pairs such that the downstream ends of respective members of the pair are coincident, each discharging the flow along a head-on collision course into region 70 as seen in FIG. 8. Since the disturbances produced by respective members of each pair are inphase but opposite in direction, destructive interaction occurs at frequencies as high as 10 MHz. At 10 MHz, for example, the destructive interactions would occur ten million times per second, each time resulting in a complete angular momentum transfer in a relatively small region of the high intensity energy field. The law of impulse averages the magnitude of the force (amplitudes) concentrated in the small region approximately ten million times relative to a nonorthokinetically colliding vortical flow with identical driving forces. Both the constant high frequency and uniform magnitude of impulses insures the most favorable physical conditions for droplet size and uniformity of vapor phase constituents.

Referring specifically to FIG. 8, it will be seen that a series of slits 72 radially intersect region 70 in between the cavities 66. Slits 72 communicate between region 70 and combustion zone 14 permitting the fragmented constituents to pass into the combustion zone 14 after fragmentation.

It is evident that the destructive interaction will result in a different spray pattern from that resulting from the parakinetic constructive interaction characteristic of the first embodiment of the invention. Because colliding particles are subject to the law of reflection, namely that the incident angle is equal to the scattered angle and because the incident constituents fragment upon collision, they are spherically scattered relative to the resultant vector. Consequently, the spray pattern of the nozzle of FIGS. 7 and 8 will have a pattern, differing from the so-called solid cone or hollow cone pattern produced by conventional nozzles to the extent that the axial space will not be hollow, but filled with superfine scattered constituents.

Figure 9:
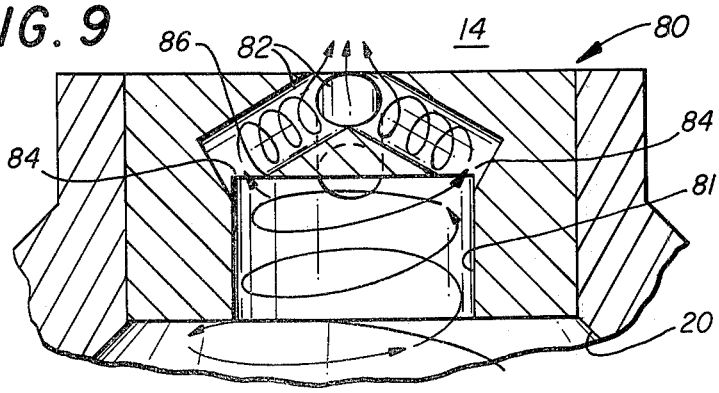
FIG. 9 is a schematic section view of the third embodiment of the invention in which interactions have both parakinetic and orthokinetic components.

Referring now to FIG. 9, the third embodiment of the invention is shown in which the frequency multiplier and amplitude amplifier 80 is designed to produce a wave interaction which has both parakinetic and orthokinetic components. As best seen in FIG. 9, the vortical flow produced in the swirl chamber is discharged into a cylindrical compression chamber 81 which has smaller diameter than the swirl chamber to increase the angular momentum of the fluid. In this embodiment, the compression chamber 81 and multiplier cavities 82 are likewise analagous to the inlet and outlet cavities of Vonnegut's "vortex whistle". The axes of the multiplier cavities 82 are oriented at an angle between zero and ninety degrees with respect to the axis of the compression chamber, the particular angle selected to generate the most favorable spray pattern for a given application. Cavities 82 intersect the wall of the compression chamber 81 defining a series of ports 84 through which the flow in the chamber 81 is discharged. At the point where the walls of the cavities and the wall of the compression chamber intersect, sharp edges 86 are defined which provide the sharp edged coupling between the compression chamber and multiplier cavities. Cavities 82 are paired with respect to the axis of the amplifier and form a ring of resonating sources at the downstream end of the amplifier similar to the first embodiment. This structure produces a partly parakinetic interaction as a result of the constructively interfering ring of resonating cavities and a partly destructive orthokinetic interaction as a result of head-on collisions of resonating force fields. As the resulting disturbance produced by the frequency multiplier and amplitide amplifier 80 is a combination of both the parakinetic and orthokinetic interactions, the spray pattern produced will be a combination of both the highly directed pattern (FIG. 6) characteristic of the parakinetic constructive interaction and the spherical slice pattern characteristic of the orthokinetic destructive interaction, the precise shape of the resulting envelope depending upon the dimensions and number of cavities and the angular orientation of the axes.

In all of the three embodiments illustrated herein, the dimension and number of multiplier cavities are not fixed, but may be chosen to achieve particular atomization conditions.

The improved nozzle disclosed herein is not limited to uses with liquid fuels in conventional oil burners, but has wider application. For example, the nozzles have application in atomizers for fuel injectors in diesel, jet engines and internal combustion engines. The structure disclosed herein is not limited to combustion of liquid fuel, but is suitable for atomization of other liquids. It will be evident to those of ordinary skill in the art that the atomizers disclosed herein will also have a wide variety of uses in industrial, environmental, medical and chemical fuel injection or atomization systems such as oil refineries, power plants, cement plants, cooling towers, scrubbers or medical atomizers.

Although preferred embodiments of the invention have been illustrated in the accompanying drawings and described in the foregoing detailed description, it will be understood that the invention is not limited to the embodiments shown and described, but is capable of numerous rearrangements, modifications and substitutions of parts or elements without departing from the spirit and scope of the invention.

I claim:

1. Apparatus for fragmenting fluids into superfine constituents comprising:

a vortex generator of generally circular cross section into which a fluid under pressure is tangentially fed to produce a vortical flow;

means for supplying fluid to the swirl chamber;

a frequency multiplier and amplitude amplifier disposed downstream of the swirl chamber, responsive to the fluid pressure for generating a high frequency sonic field in the flow;

a frequency multiplier and amplitude amplifier having a generally circular compression chamber disposed coaxially of the swirl chamber, the compression chamber being open at the upstream end and closed at the downstream end; and the frequency multiplier and amplitude amplifier also having a plurality of generally cylindrical multiplier cavities of smaller diameter than the compression chamber, the multiplier cavities being arranged in a ring which is coaxial with the compression chamber and slightly downstream thereof with the cavities peripherally intersecting the outer wall of the compression chamber to define a series of ports through which the flow may be discharged.

2. The apparatus of claim 1 wherein the means for supplying fluid to the swirl chamber supplies fluid at sufficient pressure to produce an ultrasonic field in the flow having a frequency of at least about 1 MHz.

3. The apparatus of claim 1 wherein the means for supplying fluid to the swirl chamber supplies fluid to the swirl chamber at constant pressure to fragment the constituents into a substantially uniform size.

4. The apparatus of claim 1 wherein:

the multiplier cavities are paraxial with the compression chamber.

5. The apparatus of claim 1 wherein:

the multiplier cavities are arranged in pairs positioned oppositely one another relative to the axis of the compression chamber, the axis of each multiplier cavity being oblique to the axis of the compression chamber at a common angle thereto.

6. Apparatus for fragmenting fluids into superfine constituents of substantially uniform size comprising:

a swirl chamber of generally circular cross section into which a fluid under pressure is tangentially introduced to produce a vortical flow;

means for supplying the fluid to the swirl chamber at constant pressure;

a frequency multiplier and amplitude amplifier disposed downstream of the swirl chamber, responsive to the fluid pressure for generating a constant high frequency sonic field in the flow;

the frequency multiplier and amplitude amplifier having a generally circular compression chamber disposed coaxially of the swirl chamber, the compression chamber being open at the upstream end and closed at the downstream end;

the frequency multiplier and amplitude amplifier also having a plurality of generally cylindrical multiplier cavities of smaller diameter than the compression chamber, disposed downstream of the compression chamber, the multiplier cavities being arranged in a ring coaxial of the compression chamber with the multiplier cavities paraxially aligned therewith; and the multiplier cavities being open at the upstream end such that a series of ports are provided in the compression chamber whereby the vortical flow in the compression chamber may be discharged into the multiplier cavities, the multiplier cavities being open at the downstream end to discharge the constituents therefrom.

7. Apparatus for fragmenting fluids into superfine constituents of substantially uniform size comprising:

a swirl chamber of generally circular cross section into which a fluid under pressure is tangentially introduced to produce a vortical flow;

means for supplying the fluid to a swirl chamber at constant pressure;

a frequency multiplier and amplitude amplifier disposed downstream of the swirl chamber responsive to the fluid pressure for generating a constant high frequency ultrasonic field in the flow;

the frequency multiplier and amplitude amplifier having an annular compression chamber coaxial wth the swirl chamber, the compression chamber being open at the upstream end and closed at the downstream end;

the frequency multiplier and amplitude amplifier also having a plurality of multiplier cavities disposed downstream of the compression chamber, the multiplier cavities being arranged to form a ring of opposing pairs, the ring being coaxial of the compression chamber with the axes of the multiplier cavities being orthogonal to the axis of the compression chamber;

the multiplier cavities communicating with the compression chamber by means of a series of ports in the compression chamber whereby the vortical flow in the compression chamber may be discharged into each of the multiplier cavities; and the multiplier cavities being open at the downstream end and positioned such that each member of the pair is coincident with its opposing member.

8. Apparatus for fragmenting fluids into superfine constituents of substantially uniform size comprising:

a swirl chamber of generally circular cross section into which a fluid under pressure is tangentially introduced to produce a vortical flow;

means for supplying the fluid to the swirl chamber at constant pressure;

a frequency multiplier and amplitude amplifier disposed downstream of the swirl chamber responsive to the fluid pressure for generating an ultrasonic field of constant frequency in the flow;

the frequency multiplier and amplitude amplifier having a generally cylindrical compression chamber coincident with the swirl chamber being disposed downstream thereof, the compression chamber being open at the upstream end and closed at the downstream end;

the frequency multiplier and amplitude amplifier also having a plurality of generally cylindrical multiplier cavities, having smaller diameter than the compression chamber, disposed downstream of the compression chamber, the multiplier cavities being arranged in a ring coaxial with the compression chamber;

the multiplier cavities being open at the upstream end such that a series of ports are provided in the compression chamber wherein the vortical flow in the compression chamber may be discharged in the multiplier cavities;

the muliplier cavities being arranged in pairs which members are positioned oppositely one another relative to the axis of the compression chamber, the axis of each member being oblique to the axis of the compression chamber at a common angle thereto; and the multiplier cavities each opening downstream to discharge the flow in the direction of the axis of the compression chamber.

9. For use with a conventional oil burner nozzle of the type having a swirl chamber of generally circular cross section positioned upstream of the nozzle orifice, an atomizer adapted to be mounted inside the nozzle downstream of the swirl chamber for fragmenting fluid fuel supplied at high pressures into superfine constituents of substantially uniform size comprising:

a compression chamber of generally circular cross section adapted to be coaxially aligned with the swirl chamber, the compression chamber being open at the upstream end and substantially closed at the downstream end; and a plurality of substantially cylindrical multiplier cavities of smaller diameter than the compression chamber, disposed downstream thereof, the multiplier cavities intersecting the periphery of the compression chamber to form sharp edged ports between the intersecting walls of the overlapping multiplier cavities and the compression chamber to permit the vortical flow in the compression chamber to be discharged into the multiplier cavities.

10. The atomizer of claim 9 wherein the sonic generatior has at least four multiplier cavities.

11. The atomizer of claim 9 wherein the multiplier cavities are arranged so as to form a ring of mutually equidistant multiplier cavities, the ring being coaxial with the compression chamber.

12. The atomizer of claim 9 wherein the multiplier cavities and the compression chamber are paraxially arranged and the multiplier cavities are open at the downstream end thereof.

13. The atomizer of claim 9 wherein the axes of the multiplier cavities are arranged in pairs and the cavities are positioned obliquely to the axis of the compression chamber.

14. The atomizer of claim 9 wherein the fluid fuel is supplied at sufficiently high constant pressure to produce a resultant sonic disturbance having a constant frequency of at least about 1 MHz.

15. For use with a conventional oil burner nozzle of the type having a swirl chamber of generally circular cross section positioned upstream of the nozzle orifice, an atomizer adapted to be mounted inside a nozzle downstream of the swirl chamber for fragmenting fluid fuel supplied at high pressures into superfine constituents of substantially uniform size comprising:

an annular compression chamber adapted to be coaxially aligned with the swirl chamber, the compression chamber being open at the upstream end and substantially closed at the downstream end;

at least one pair of cylindrical multiplier cavities of smaller diameter than the compression chamber disposed downstream thereof, each member of the pair being open at the downstream end thereof and the members being arranged mutually coincident with one another perpendicular to the axis of the compression chamber; and the compression chamber defining a series of ports at the donwstream end thereof opening into each of the multiplier cavities to permit the vortical flow in the compression chamber to be discharged into the multiplier cavities.

16. The atomizer of claim 15 wherein channels are provided in the atomizer to provide communication between the region where respective members of each cavity pair coincide and the outside.

* * * * *